US008430154B2

(12) United States Patent
Yang et al.

(10) Patent No.: US 8,430,154 B2
(45) Date of Patent: Apr. 30, 2013

(54) NANO-PARTICLE WAVE HEAT PIPE

(75) Inventors: Sherwin Yang, Chatsworth, CA (US); Nathan J. Hoffman, Canoga Park, CA (US); Gregory A. Johnson, Camarillo, CA (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 1690 days.

(21) Appl. No.: 11/652,840

(22) Filed: Jan. 12, 2007

(65) Prior Publication Data

US 2010/0252245 A1 Oct. 7, 2010

(51) Int. Cl.
*F28D 15/00* (2006.01)
*F28D 13/00* (2006.01)

(52) U.S. Cl.
USPC ..... 165/104.12; 165/104.15; 165/104.16; 165/104.19; 165/104.21

(58) Field of Classification Search ..... 165/104.12, 165/104.15, 104.16, 104.19, 104.21, 104.26
See application file for complete search history.

(56) References Cited

U.S. PATENT DOCUMENTS

| | | | | |
|---|---|---|---|---|
| 425,611 | A | 5/2000 | Qu | |
| 6,132,823 | A | 10/2000 | Qu | |
| 6,632,528 | B1 * | 10/2003 | Clough | 428/402 |
| 6,811,720 | B2 | 11/2004 | Qu | |
| 6,911,231 | B2 | 6/2005 | Qu | |
| 6,916,430 | B1 | 7/2005 | Qu | |
| 7,169,489 | B2 * | 1/2007 | Redmond | 429/515 |
| 7,220,365 | B2 | 5/2007 | Qu et al. | |
| 7,566,484 | B2 * | 7/2009 | Hayes | 165/104.15 |
| 7,694,726 | B2 * | 4/2010 | Chen | 165/104.26 |
| 7,732,372 | B2 * | 6/2010 | Hampden-Smith et al. | 502/407 |
| 7,874,347 | B2 * | 1/2011 | Chen | 165/104.26 |
| 2003/0066638 | A1 | 4/2003 | Qu et al. | |
| 2005/0056807 | A1 | 3/2005 | Qu | |
| 2006/0005947 | A1 | 1/2006 | Arik et al. | |

* cited by examiner

*Primary Examiner* — Ljiljana Ciric
(74) *Attorney, Agent, or Firm* — Kinney & Lange, P.A.

(57) ABSTRACT

A heat transfer tube includes a container, a cavity within the container, and a heat transfer medium located within the cavity. The heat transfer medium consists essentially of a solid-gas suspension of a gas and a substantially homogeneous nanoparticle powder located within the cavity. The cavity is in a partial vacuum state. The nanoparticle powder comprises $Ca(OH)_2$, LiH, $ZrH_2$, or $Mg(OH)_2$ in a solid state and is capable of substantially freely emitted and reabsorbing the gas as a function of temperature.

7 Claims, 2 Drawing Sheets

NANO-PARTICLE WAVE HEAT PIPE

BACKGROUND OF THE INVENTION

The present invention relates to thermal transfer devices, and in particular to a heat pipe containing suspended nanoparticles to provide thermal superconductivity.

Electromechanical devices and chemical conversion devices require efficient means to transfer heat for energy conversions, and for waste heat dissipation. Heat pipes have been developed to provide more efficient heat transfer.

In U.S. Pat. Nos. 6,132,823 and 6,811,720, as well as Published Application Nos. U.S. 2003/0066638 and U.S. 2005/0056807, all by Yu-Zhi Qu, tubes containing one or multiple layers of inorganic compounds have been described as having extremely high thermal conductivity. The patents and patent applications describe devices exhibiting thermal conductivity 20,000 to 30,000 times the thermal conductivity of silver.

The Qu patents and patent applications describe layers containing 10 to 12 different compounds in differing weight percentages.

BRIEF SUMMARY OF THE INVENTION

A heat transfer tube includes a container, a cavity within the container, a substantially homogeneous nanoparticle powder located within the cavity, and a gas. The cavity is in a partial vacuum state. The nanoparticle powder includes a material in a solid state capable of substantially freely emitted and reabsorbing a gas as a function of temperature, such as a hydrate, hydride or other material.

DETAILED DESCRIPTION

In general, the present invention provides a heat transfer pipe (or heat transfer tube) that utilizes a superconductive heat transfer medium that enables close thermal coupling of opposite ends of the pipe, even over considerable lengths, without the need for active pumping of the heat transfer medium. A cavity inside the pipe is in a partial vacuum state, and the heat transfer medium is sealed within the cavity. The heat transfer medium includes a substantially homogeneous mixture of a nanoparticle powder and an associated gas (e.g., hydrogen gas, water vapor, etc.). The nanoparticle powder includes a material in a solid state capable of substantially freely emitted and reabsorbing a gas as a function of temperature, such as a hydrate, hydride or other gas. Likewise, the gas is capable of being substantially freely absorbed and emitted from the nanoparticle powder as a function of temperature. In that regard, "depleted" nanoparticles are solid-state particles of the nanoparticle powder that have released constituents of the gas, and "enriched" nanoparticles are solid-state particles of the nanoparticle powder that have either not released constituents of the gas or have reabsorbed constituents of the gas. The solid-state particles of the nanoparticle powder are suspended in the mixture and behave like very large gas molecules.

When heat is applied at one end of the pipe, at sufficient temperatures, very small changes in temperature will produce a net transport of enriched nanoparticles to the "hot" end of the pipe (where heat is being applied) and likewise a net transport of depleted nanoparticles to the "cold" end of the pipe (spaced from the location where heat is applied). The enriched nanoparticles will tend to evolve constituents of the gas at or near the hot end of the pipe through an endothermic process, and the depleted nanoparticles will tend to absorb the constituents of the gas at or near the cold end of the pipe through an exothermic process. This net transport can occur quickly and allows for a very high heat transport rate between the opposite ends of the pipe. Moreover, the gas evolved (i.e., emitted) from the enriched nanoparticle powder suspends (i.e., fluidizes) substantially all of the solid-state nanoparticles to form a homogeneous mixture inside the pipe. When suspended, the solid-state nanoparticles behave like very large gas molecules, which enables a high degree of heat transfer and permits the pipe to maintain a substantially isothermal condition between its opposite ends. The processes through which this occurs are explained in greater detail below.

Figure 1:
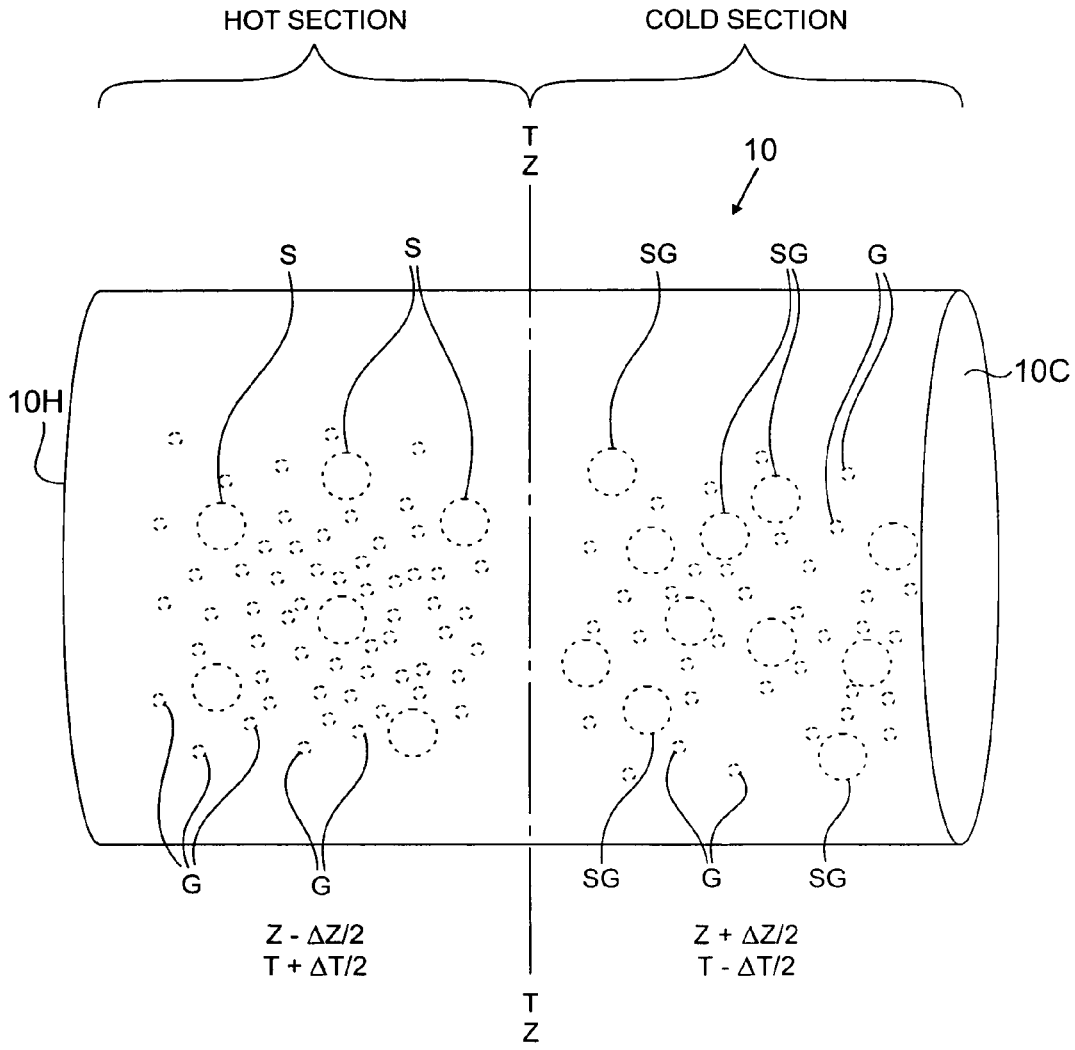
FIG. 1 is a schematic representation of a heat pipe according to the present invention.

FIG. 1 is a schematic representation of a heat pipe (or tube) 10 which defines an arbitrary pressure boundary at its interior surface. In the illustrated embodiment, the pipe 10 has an elongate shape with a generally circular cross-section, and defines a first end 10C and a second end 10H. However, in further embodiments the pipe 10 can have other shapes as desired for particular applications. The pipe 10 can be made of a metallic material, and can optionally have a lining (e.g., a quartz lining) along the interior surface of the pipe 10. An interior cavity of the pipe 10 is in a partial vacuum state. In FIG. 1, a location Z is designated at a midpoint between the two ends 10C and 10H of the pipe 10, and a temperature T corresponds to the location Z.

A heat transfer medium is located within the interior of the pipe 10. The only material required inside the pipe 10 is the heat transfer medium, which has a substantially homogeneous composition, as will be explained further below. The heat transfer medium includes a nanoparticle powder SG that is in a solid state and possesses the ability to freely emit and absorb a gas G. This can be represented in equation form as follows:

$$SG_{(s)} \leftrightarrow S_{(s)} + G_{(g)}$$

where SG is the nanoparticle powder in solid form (also called "enriched" nanoparticles), G is the gaseous constituent, S is the solid constituent (also called "depleted" nanoparticles). In the equation above, the parenthetical subscript s designates a solid state and the parenthetical subscript g designates a gaseous state. The nanoparticle powder SG is a hydrate, hydride, or other gas and has an average particle size on the order of tens (10s) to hundreds (100s) of nanometers in diameter or width. Some examples of suitable heat transfer media include, but are not limited to the following:

$$Ca(OH)_{2(s)} \leftrightarrow CaO_{(s)} + H_2O_{(g)}$$

$$k_2Cr_2O_7.xH_2O_{(s)} \leftrightarrow k_2Cr_2O_{7(s)} + xH_2O_{(g)}$$

$$2LiH_{(s)} \leftrightarrow 2Li_{(s)} + H_{2(g)}$$

$$ZrH_{2(s)} \leftrightarrow Zr_{(s)} + H_{2(g)}$$

$$MgO_{(s)} \leftrightarrow Mg(OH)_{2(s)} + H_2O_{(g)}$$

When the enriched nanoparticle powder SG emits its gaseous constituent G, the process is endothermic. When the gaseous constituent G is reabsorbed by the depleted nanoparticle solid S, the process is exothermic. The gas G evolved (i.e., emitted) from the enriched nanoparticle powder SG suspends (i.e., fluidizes) the nanoparticles S (and SG) to form a homogeneous mixture inside the pipe 10. When suspended, the nanoparticles S (and SG) behave like very large gas molecules and exhibit random, gas-like motion.

Figure 2:
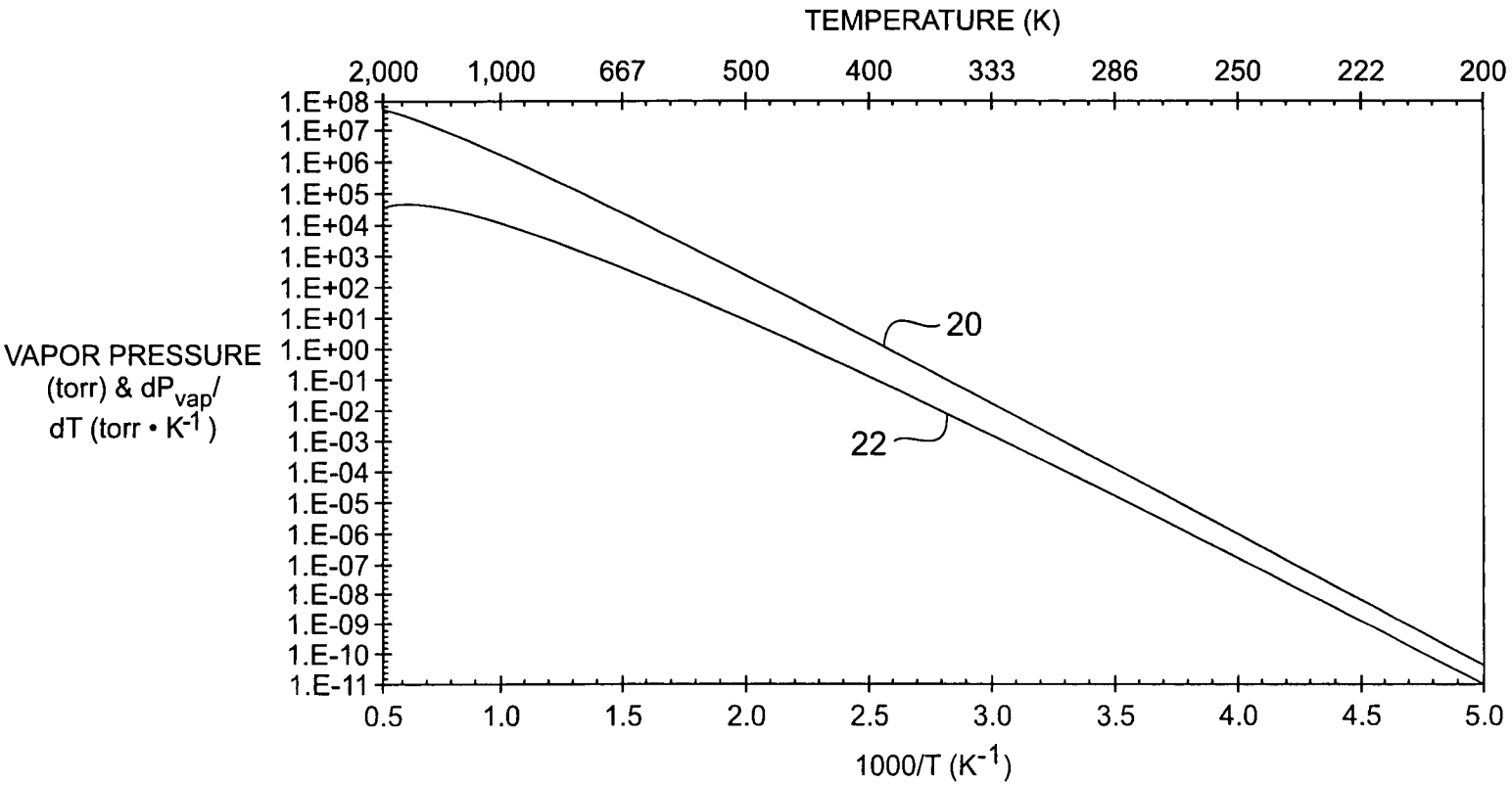
FIG. 2 is a graph of vapor pressure and vapor pressure slope versus temperature for a MgO, $Mg(OH)_2$, $H_2O$ system.

The vapor pressure of the gas G emitted by the nanoparticle powder SG is dependent on the thermodynamic properties of the solid-gas nanoparticle powder system and temperature. FIG. 2 is a graph of vapor pressure 20, in pressure (torr) vs. temperature (kelvin), and slope of the vapor pressure 22, in $dP_{vap}/dt$ (torr·$K^{-1}$) vs. 1000/temperature (1000·$K^{-1}$), for an exemplary heat transfer medium comprising MgO (as the enriched nanoparticle powder SG), $Mg(OH)_2$ (as the depleted solid constituent S) and $H_2O$ (as the gaseous constituent G) located within the pipe 10. Graphs for alternative heat transfer media will vary slightly. In all embodiments, however, both the vapor pressure and the slope of the vapor pressure are exponential functions of temperature. As a consequence, at sufficient temperatures, very small changes in temperature result in significant changes in vapor pressure inside the pipe 10. It is this phenomena that sets up the driving force for the super thermal conductivity that occurs in the pipe 10.

Referring again to FIG. 1, a temperature gradient is applied to the pipe 10 such that thermal energy is added to the pipe 10 at its second end 10H. At the "hot" section of the pipe 10 at an arbitrarily small distance toward the second end 10H from the location Z (i.e., at position $Z-\Delta Z/2$ and at a corresponding temperature $T+\Delta T/2$), the vapor pressure and hence, vapor density will be greater than at the "cold" section of the pipe 10 (i.e., at position $Z+\Delta Z/2$ and at a corresponding temperature $T-\Delta T/2$). This results in a concentration gradient of the gas G (i.e., vapor) within the interior of the pipe 10, with a greater concentration of the gas G near the second end 10H of the pipe 10, as the nanoparticle powder SG absorbs heat energy at the second end 10H of the pipe 10 and emits the gas G. Furthermore, the total pressure, and therefore the total molecular density (of the gas G plus the depleted nanoparticles S) within the pipe 10 must remain unchanged. Thus a concentration gradient of the depleted nanoparticles S that is equal in magnitude, but opposite in direction to the concentration gradient of the gas G, will also be set up within the pipe 10. This results in a concentration gradient of the depleted nanoparticles S within the interior of the pipe 10 as the depleted nanoparticles S at the first end 10C of the pipe 10 re-absorb the gas G and releases heat energy to reform the nanoparticle powder SG.

Gas molecules G will evolve from enriched nanoparticles SG that have migrated into the hot section (at temperature $T+\Delta T/2$ and at position $Z-\Delta Z/2$), absorbing their heat of vaporization. Driven by the vapor concentration gradient, these gas molecules G migrate to the cold section (at temperature $T-\Delta T/2$ and at position $Z+\Delta Z/2$) where they are absorbed by depleted nanoparticles S, releasing their heat of vaporization. Further, the depleted nanoparticles S will tend to migrate up the temperature gradient due to the equal but opposite concentration gradient of depleted nanoparticles S. However, the "drag" exerted on the depleted nanoparticles S by the gas G flowing in the opposite direction will cause a "standing" gradient of depleted nanoparticles S to be established within the pipe 10. The net result is no net flow of nanoparticles S and SG within the pipe 10. However, there will be a net transport of enriched nanoparticles SG into the hot section from the cold section, and likewise a net transport of depleted nanoparticles S into the cold section from the hot section.

The net rate of heat transport within the pipe 10 is the rate at which the gas molecules G migrate down the temperature gradient multiplied by the heat required to emit a gas molecule G from the enriched nanoparticle powder SG. The rate at which the gas molecules G (and the nanoparticles S and SG) migrate between the ends 10C and 10H of the pipe 10 is governed by diffusion. The diffusion rate within the pipe 10 is dependent on the concentration gradient, mean velocity of the gas molecules G and on the mean free path between collisions. See, generally, R.D. Present, Kinetic Theory of Gases (McGraw-Hill Book Co., 1958). The mean free path between collisions is dependent on the inverse of the gas density. Id. This implies that by keeping the combined density of gas G and depleted nanoparticles S low will enhance the diffusion rate and hence the heat transport rate of the pipe 10.

Because the mixture of gas molecules G and suspended nanoparticles S and SG behaves like a gas, the thermal conductivity of the heat transfer medium can be estimated using the kinetic theory of gases. Thus, the overall thermal conductivity of the pipe 10 can be estimated with a relatively high degree of precision.

The behavior of the nanoparticle powder SG like a gas is important to the efficient operation of the pipe 10. However, solid nanoparticle powders SG may tend to cluster together due to particle surface charges. If this clustering problem is not addressed, the nanoparticles SG will tend to agglomerate and "fall out" of the mixed solid-gas suspension, lessening the super thermal conductivity of the pipe 10. A number of alternative solutions to this problem are contemplated within the scope of the present invention. First, it is common practice to use radiation to eliminate static charges. Thus, adding a small amount of radioactivity by exposing the nanoparticles S and SG to radiation or including naturally radioactive elements in the nanoparticle materials, as well as exposing the material of the pipe 10 (e.g., to a quartz lining of the pipe 10) to radiation or forming the pipe 10 with a naturally radioactive element will eliminate surface charges of the heat transfer medium and reduce agglomeration. Another suitable approach would be to provide a nearby external source of radiation to accomplish the same objective within the pipe 10. All of these approaches are herein collectively referred to as "irradiating" the nanoparticles for simplicity, although it should be understood that this term is meant to generally describe a situation where radiation acts to reduce agglomeration of the nanoparticles within the pipe 10. Alternatively, if the gas G in the system is polarized (e.g., the gas G is a $H_2O$ molecule), the surface of the enriched nanoparticles SG can also be polarized by the condensing gas G which will cause the enriched nanoparticles SG to naturally repel each other preventing agglomeration.

In view of the description above, it should be recognized that the heat pipe 10 can achieve superconductive heat transfer and quickly achieve thermal equilibrium between the first and second ends 10C and 10H of the pipe 10. In that way, the pipe 10 behaves substantially like an isothermal member. Because only the substantially homogenous heat transfer medium is required, the pipe 10 can be produced to relatively precise tolerances with predetermined heat transfer properties. Moreover, the reduction of agglomeration effect allows the pipe 10 to maintain its thermally superconductive properties over a relatively long life cycle.

Although the present invention has been described with reference to preferred embodiments, workers skilled in the art will recognize that changes may be made in form and detail without departing from the spirit and scope of the invention. For instance, the physical structure of a heat pipe according to the present invention can take nearly any shape.

What is claimed is:

1. A heat transfer tube comprising:

a container defining opposite first and second ends and an interior surface;

a cavity within the container, the cavity in a partial vacuum state; and a heat transfer medium sealed within the cavity, the heat transfer medium consisting essentially of a solid-gas suspension of water vapor and a compositionally homogeneous nanoparticle powder of $Ca(OH)_2$ in a solid state capable of emitting and reabsorbing the water vapor as a function of temperature, and wherein a given nanoparticle of the nanoparticle powder is present within the cavity as CaO when the water vapor has been emitted by the given nanoparticle.

2. The heat transfer tube of claim 1, wherein the interior surface of the container and the nanoparticle powder have substantially the same electrical charge.

3. The heat transfer tube of claim 1, wherein the nanoparticle powder has an average particle size of about 10 nanometers.

4. The heat transfer tube of claim 1, wherein the nanoparticle powder is irradiated to reduce agglomeration within the powder.

5. A heat transfer assembly comprising:

a container enclosing an internal cavity in a partial vacuum state; and a heat transfer medium sealed within the internal cavity, the heat transfer medium consisting essentially of:

a nanoparticle powder of a homogeneous composition of $Ca(OH)_2$ in a solid state; and a gas, wherein the gas is water vapor capable of being freely absorbed and emitted from the nanoparticle powder as a function of temperature, and wherein a given nanoparticle of the nanoparticle powder is present within the internal cavity as CaO when the water vapor has been emitted by the given nanoparticle.

6. The assembly of claim 5, wherein the nanoparticle powder has an average particle size of about 10 nanometers.

7. A heat transfer assembly comprising:

a container enclosing an internal cavity in a partial vacuum state; and a heat transfer medium sealed within the internal cavity, the heat transfer medium consisting essentially of:

a nanoparticle powder consisting essentially of a material selected from the group of consisting of $Ca(OH)_2$, LiH, $ZrH_2$, and MgO; and a gas, comprising water vapor or hydrogen gas as a function of the material of the nanoparticle powder, wherein the gas is capable of being absorbed and emitted from the nanoparticle powder as a function of temperature, and wherein a given nanoparticle of the nanoparticle powder is present within the internal cavity as CaO, Li, Zr or $Mg(OH)_2$ when the gas has been emitted by the given nanoparticle.

* * * * *